US010883329B2

(12) United States Patent
Tøndel et al.

(10) Patent No.: US 10,883,329 B2
(45) Date of Patent: Jan. 5, 2021

(54) IGNITOR, SYSTEM AND METHOD OF ELECTRICAL IGNITION OF EXOTHERMIC MIXTURE

(71) Applicant: INTERWELL P&A AS, Hafrsfjord (NO)

(72) Inventors: Stian Tøndel, Trondheim (NO); Kent-Andre Bomann, Flatåsen (NO); Michael Skjold, Ranheim (NO)

(73) Assignee: INTERWELL P&A AS, Hafrsfjord (NO)

( * ) Notice: Subject to any disclaimer, the term of this patent is extended or adjusted under 35 U.S.C. 154(b) by 253 days.

(21) Appl. No.: 16/060,607

(22) PCT Filed: Dec. 1, 2016

(86) PCT No.: PCT/EP2016/079475
§ 371 (c)(1),
(2) Date: Jun. 8, 2018

(87) PCT Pub. No.: WO2017/097663
PCT Pub. Date: Jun. 15, 2017

(65) Prior Publication Data

US 2018/0371859 A1 Dec. 27, 2018

(30) Foreign Application Priority Data

Dec. 9, 2015 (NO) ..... 20151689

(51) Int. Cl.
*E21B 29/02* (2006.01)
*E21B 36/00* (2006.01)
(Continued)

(52) U.S. Cl.
CPC ..... *E21B 29/02* (2013.01); *E21B 29/10* (2013.01); *E21B 33/13* (2013.01); *E21B 36/008* (2013.01)

(58) Field of Classification Search
CPC ..... E21B 36/008; E21B 43/11
See application file for complete search history.

(56) References Cited

U.S. PATENT DOCUMENTS 2,530,834 A * 11/1950 Martin ..... E21B 43/116 175/4.58
2,996,007 A 8/1961 Franklin
(Continued)

FOREIGN PATENT DOCUMENTS

WO 03/071084 A2 8/2003
WO 2005/010456 A2 2/2005
(Continued)

OTHER PUBLICATIONS

International Search Report issued in PCT/EP2016/079475 dated Feb. 3, 2017 (6 pages).
(Continued)

*Primary Examiner* — Tara Schimpf
*Assistant Examiner* — Dany E Akakpo
(74) *Attorney, Agent, or Firm* — Osha Bergman Watanabe & Burton LLP

(57) ABSTRACT

A system and a method of an ignitor for electrical ignition of an exothermic mixture to be used in wells, for the purposes of reinstatement of a barrier in well(s), subterranean storage reservoirs for a variety of potential environmental damaging materials such as CO2, radioactive storage, and other uses. Additionally, the ignitor may include a housing with a compartment within the housing, a first exothermic mixture of at least a metal and an oxide provided in the compartment, a first electrode connectable to a first terminal of a power supply, and a second electrode connectable to a second terminal of the power supply.

13 Claims, 6 Drawing Sheets

(51) Int. Cl.
*E21B 29/10* (2006.01)
*E21B 33/13* (2006.01)

(56) References Cited

U.S. PATENT DOCUMENTS

2006/0144591 A1 7/2006 Gonzalez et al.
2014/0251612 A1* 9/2014 Powers ..... B29C 48/154
166/281

FOREIGN PATENT DOCUMENTS

WO 2013/135583 A2 9/2013
WO 2015/116261 A1 8/2015

OTHER PUBLICATIONS

Written Opinion of the International Searching Authority issued in PCT/EP2016/079475 dated Feb. 3, 2017 (6 pages).

* cited by examiner

IGNITOR, SYSTEM AND METHOD OF ELECTRICAL IGNITION OF EXOTHERMIC MIXTURE

FIELD OF THE INVENTION

The invention relates to an electrical ignitor, a system comprising an electrical ignitor and a method of electrical ignition of an exothermic mixture. The exothermic mixture may e.g. be arranged in a wellbore for plugging and abandoning (P&A) a well by melting the surrounding materials.

BACKGROUND OF THE INVENTION

Wellbores in subterranean formations have a variety of areas of use today. They may be used for the purposes of e.g. hydrocarbon production reservoirs, extraction of earth heat, as subterranean storage reservoirs for a variety of potential environmental damaging materials such as CO2, radioactive materials, etc. However, when the wellbore is no longer to be used for the desired purpose identified above, i.e. abandoned, there are different solutions on how to abandon the formation existing on the market today.

For example, to meet governmental requirements during plugging and abandonment (P&A) operations of a hydrocarbon well, a deep set barrier must be installed as close to the potential source of inflow as possible, covering all leak paths. A permanent well barrier shall extend across the full cross section area of the wellbore, including all annuli, and seal both vertically and horizontally in the well. This requires mechanical removal of tubing, or perforating tubulars followed by washing behind the tubulars. This will lead to that swarf and debris from for example mechanical milling, need to be cleaned out of all flowlines, including the BOP system, to the rig. Normally cement is used for the purpose of P&A operations. However, the well barrier has to comply with all of the following requirements for a P&A barrier (reinstated barrier), which may vary in different countries (NORSOK, API etc.); a) impermeability, b) long term integrity, c) non shrinking, d) ductility (non brittle)—able to withstand mechanical loads or impact, e) resistance to different chemicals/substances (H2S, CO2 and hydrocarbons) and f) wetting—to ensure bonding to steel.

The exothermic mixture may comprise e.g. a thermite mixture. Thermite is normally known as an exothermic composition of a metal powder and a metal oxide. The metal powder and the metal oxide produce an exothermic oxidation-reduction reaction known as a thermite reaction. A number of metals can be the reducing agent, e.g. aluminium. If aluminium is the reducing agent, the reaction is called an aluminothermic reaction. Most of the varieties are not explosive, but may create short bursts of extremely high temperatures focused on a very small area for a short period of time. The temperatures may reach as high as 3000° C. Such a barrier is e.g. disclosed in application WO 2013135583 A2 filed by the same applicant as the applicant in the present invention.

Another prior art document disclosing an alternative initiating process, include WO 03/071084 A2 relating to a system for forming an opening, or window, in a downhole tubular for the subsequent formation of a lateral wellbore. The initiation process may be performed using an electrical assembly. The electrical assembly includes two electrical conductors extending from the surface of the well and attached to an electrode therebetween in a housing of the thermite initiator. At a predetermined time, an electrical signal is supplied from the surface of the well and the electrode rises to a temperature adequate to initiate burning of thermite located proximate the electrode. Subsequently the thermite in the wall of a container portion burns to form the window in the casing C. As the thermite process takes place, thermite and casing material flow down into the opening and are captured in the lower portion of milling device.

An objective of the invention is to provide a reliable electrical ignitor, a system comprising an electrical ignitor and method of electrical ignition of an exothermic mixture.

Another objective of the invention is to provide a solution for well abandonment which can be conducted from a light intervention vessel.

Another objective of the invention is to reduce or remove the need for a rig in P&A operations.

A further objective of the invention is to provide an ignitor for downhole use which may be transported, stored, handled and used without any restrictions to shipping, handling, storage and with high EX classification index.

SUMMARY OF THE INVENTION

The invention is set forth and characterized in the independent claims, while the dependent claims describe alternative embodiments of the invention.

The applicant has invented an ignitor and a method of electrical ignition of an exothermic mixture to be used e.g. in wells, for the purposes of e.g. reinstatement of a barrier in well(s), subterranean storage reservoirs for a variety of potential environmental damaging materials such as CO2, radioactive storage, etc.

The invention relates to an ignitor, a system for ignition as well as a method of activation.

The invention relates to an ignitor for use in a wellbore, the ignitor comprising:

- a housing;
- a compartment provided within the housing;
- a first exothermic mixture of at least a metal and an oxide provided in the compartment;
- a first electrode connectable to a first terminal of a power supply;
- a second electrode connectable to a second terminal of the power supply;
- where at least parts of the first and second electrodes are in contact with the first exothermic mixture;

where the first electrode and the second electrode are provided at a distance from each other, wherein, upon appliance of a voltage above a predetermined threshold value between the first and second electrodes an electromagnetic field is created in the first exothermic mixture between the first and second electrodes. This results in that the first exothermic mixture heats up to its reaction temperature.

According to an aspect, the ignitor may further comprise a holder for holding the first electrode and the second electrode, wherein the holder is made of an electric isolating material. This is advantageous in order to be able to control parameters such as distance between electrodes, number of electrodes and secure that the electrodes are parallel. This electric isolating material may in one embodiment be a thermoplastic polymer or ceramic element.

In an aspect of the ignitor, the housing may further comprise at least one pressure seal adapted to seal against a pressure difference between an outside of the housing and an inside of the housing. The pressure seal may be a low-pressure seal, or alternatively a high pressure seal, depending on the requirements in the specific project. The seal may, according to an aspect, be a flexible low-pressure packer, wherein the flexible low-pressure packer protects the connection between the first electrical conductor and the first electrode as well as the second electrical conductor and the second electrode, respectively. The flexible low pressure packer is typically used when the expected pressure is below 10 bar, while the high pressure seal may be used when expecting pressures up to 350 bar and above.

The housing may be formed of a high-alloyed metal and covered by an insulating surface such that at least strength and electrical parameters of the housing can be controlled. Such material may e.g. be aluminium 7075-T6 because of its favorable properties with regards to high strength and temperature. This material could have a surface treatment e.g. anodization to increase the electrical insulation properties between housing, electrode and outside exothermic mixture, as well as increased surface hardness to protect against wear and tear.

The first and second electrodes may be formed by stainless steel and have a variety of diameters ranging from 0.1-10 mm. The length of the electrodes may range from 1-100 mm dependent on the required ignition etc.

The distance between the electrodes are preferably in the range of 3-10 mm. 4 electrodes provide for potentially 6 (electromagnetic fields) between the electrodes (1 primary and 5 back up fields) and provides redundancy in the system. The distance between the electrodes may be increased or decreased to be shorter or longer than said range, and will depend on the resistivity and electric potential (current/voltage) applied between the different electrodes.

According to an aspect, the electrode may be formed of a metal alloy having at least one of the following properties: low electrical resistance, high corrosion resistance, high strength and melting temperature above 1400° C. Such a metal alloy may e.g. be 316L.

According to an aspect, the at least first electrode and second electrode may be embedded in the first exothermic mixture by use of a binding agent.

The binding agents could be mineral-, silicon- or thermoplastic based. As the required properties would be the basis of the mixture applied. Mineral based binders would be used for increased hardness and strength, and silicon- or thermoplastic based binders would be used to increase ductility.

In an aspect, the first exothermic mixture may comprise fine-grained particles of metal and oxide particles having a particle size between 0.1 and 1 mm. By using this particle size, there are no specific requirements with regards to storage, transport, handling etc. There is no risk of auto ignition/spontaneous ignition of the exothermic mixture.

The fine-grained mixture is balanced with regards to the required amount to activate the mixture, as well as better control on the distribution of the oxide and metal, and then to reduce the effect of granular convection where any movement may be an issue when it comes to for example the distribution of the fine-grained particles in the mixture.

Additionally, the invention relates to a system for electric ignition of an exothermic mixture, the system comprising at least one ignitor as described above, wherein the system further comprises a power supply with its first terminal connected to the first electrode and its second terminal connected to the second electrode of the ignitor, where the power supply comprises an electric power source and control device. The connections between the first electrode and the first terminal of the power supply may be via a first electrical conductor and the connection between the second electrode and the second terminal may be via a second electrical conductor.

According to one aspect, the power supply may be provided separate from the ignitor, i.e. on deck/topside on a rig, platform, Light Well Intervention vessel or remote control room, etc.

The electrical current from the power supply may be based on a direct current source (DC source). This source may be of the same type and strength, i.e. have the same properties, as the DC source already in place at the location, typically used in downhole operations. This may e.g. be the same current source as when operating a wireline tractor or similar.

At the location of ignition, i.e. in the ignitor, the parameters relating to current and voltage is preferably in the magnitude of 3 Ampere and 200 Volt, but is not limited to these specific magnitudes.

According to an aspect of the system, the control device comprises a switch device connected between the ignitor and the electric power source. The switch device may be incorporated into the power supply, i.e. as part of a control device in the power supply. The control device may, either by manual or automatic programming, direct voltage to the different ignitors either simultaneously to all of the ignitors, or alternatively one at the time at given intervals. The intervals may e.g. be between 1 and 30 seconds, and normally as small as possible. Such an arrangement provides redundancy in the system because e.g. if one of the ignitors fails to ignite, it is still two more possibilities for a successful ignition. It is obvious that the system may comprise any other number than three different ignitors, such as two, four, five, six, seven etc. A larger number of ignitors will provide for even more redundancy in the system. The system can be run both with and without interpreting the results of the active signal, i.e. even if the first ignitor has ignited, the control device will apply voltage to the electrodes in the second and third ignitors in a predefined ignition sequence. Alternatively, the system may be smart, i.e. by interpreting the signals received from the first ignitor and then, based on said signals, decide on which ignitor to apply voltage next.

According to an aspect, the electric power source may comprise a battery, and the switch device may be a time switch. If the power supply comprises a battery, the battery and time switch may be lowered into the well together with the ignitor. In such situations, it is desirable that the battery is timer operated. Then no wires or cables are need, i.e. necessitated, between the place of ignition and the surface. The ignitor, including any battery and timer etc. may then be installed at the desired location using wireline, coiled tubing or similar.

According to an aspect, the system may further comprise a second exothermic mixture comprising at least a metal and an oxide, wherein the second exothermic mixture may at least partly enclose said housing, such that an ignition of the first exothermic mixture ignites the second exothermic mixture. After ignition by the first exothermic mixture, the second exothermic mixture burns at a temperature as high as 3000° C. This high temperature will melt everything in proximity/adjacent to the second exothermic mixture, such as wellbore elements i.e. casing and tubular pipes, cement, hydraulic cables and communication lines, geological formation etc.

In an aspect, the second exothermic mixture may comprise iron oxide and aluminium, but also other compositions may be used, examples which are given below.

The principle of ignition used by the ignitor according to the present invention is to control the resistivity of the material between two or more electrodes. The electric resistivity creates heat as a result of the resistivity in the oxide and the electrical current from the source, which again heats the metal to the reaction temperature. The metal alloy then reacts spontaneously creating a chemical reaction (exothermic reduction-oxidation reaction) with the oxide. The metal uses the oxygen atom from the oxide, and this process continues until all of the material has reacted. There is sufficient amount of oxide (and hence oxygen) for (all) the metal to react. The metals and oxides of the first and second exothermic mixtures may comprise combinations of, but are not limited to, aluminium, magnesium, wolframoxide, calcium, boron etc. The mixing ratios of metal and oxide may vary depending on the type of metal and oxide, such as e.g. a weight-ratio between 1:3 to 1:1. It is apparent that the weight-ratio is not limited to this specific values and that it may be both higher and lower.

According to an aspect, the second exothermic mixture may fully enclose the housing, i.e. the ignitor(s). This is advantageous in order to increase the possibility of a successful ignition.

According to an aspect, the power supply may comprise data for representation of previous successful ignitions, and an operator may decide whether an ignition has been successful or not based on comparison with said data. A successful ignition depends on the relationship between the following parameters:

- the distance between the two or more electrodes,
- length of the electrodes,
- composition of the metal/oxide mixture,
- the particle size of the materials in the first exothermic mixture,
- the magnitude of the current/voltage,
- distance of electric signal and resistance in electric conductors.

If one of the parameters is shifted, one may experience an unstable ignition, and eventually, ignition may be impossible. Empirical studies of several experiments have shown that, if one of the identified parameters is out of its suitable range, for example if the voltage/current is too low, or if the distance between two electrodes is too short, a "bridge" of oxide may be formed between at least two of the electrodes, and the heat generated from this bridge is not sufficient to ignite the metal. The reason is that the bridge may be formed too fast for the temperature-increase to be sufficient and the temperature is therefore not sufficient high to ignite the metal.

When current/voltage is applied from topside through a cable/wire/conductor and down into a well, an operator reads/registers the amount of current and voltage flowing through the cable (analog or digital). By continuous logging/measuring of different parameters in all tests performed in an environment as realistic as possible (e.g. depth, pressure, voltage), an extensive "experience database", i.e. a set of data for representation of previous successful ignitions can be made. Thus, an operator may, by comparing with this set of data, and within a short period of time, decide on whether an ignition has been successful or not. The set of data may comprise data of both successful and unsuccessful ignitions. The data may comprise e.g. a plot of current/voltage etc. In one embodiment, ignition will occur within 10 seconds, but this time interval may also be longer. Confirmation of a successful (or unsuccessful) ignition is typically determined within 2 seconds by live monitoring a plot of current as a function of voltage. The person skilled in the art will know how to use the experience database such as to determine this. Therefore, the experience database will not be described in closer detail herein.

The term 'Exothermic mixture' shall be understood as any mixture which, when it reacts, enables a chemical or physical reaction that releases heat, e.g. a thermite reaction. That is, the reaction is exothermic if the medium in which the reaction takes place produces heat. This reaction gives net energy to its surroundings.

It is further described a method of activation of an exothermic mixture, the method comprises the steps of:

- locating a second exothermic mixture at a desired position in a well,
- locating an ignitor in proximity of the second exothermic mixture, the ignitor comprising:
  - a housing;
  - a compartment provided within the housing;
  - a first exothermic mixture provided in the compartment;
  - a first electrode connectable to a first terminal of a power supply;
  - a second electrode connectable to a second terminal of the power supply;
  - where the first electrode and the second electrode are provided at a distance from each other;

wherein the method comprises the step of:

applying a voltage above a certain threshold value between the first and second electrodes thereby creating an electromagnetic field in the first exothermic mixture between the first and second electrodes.

In an aspect, the method may comprise the step of positioning at least one high temperature resistant element close to the melting position in the well. The high temperature resistant element serves to protect parts of the well or well elements that lies above, below and/or contiguous to the melting position. The high temperature resistant element may be made of high temperature resistant materials such as a ceramic element or a glass element. There may be arranged one or more high temperature resistant elements in the well.

For lowering the second exothermic mixture to a desired position in the subterranean formation, the second exothermic mixture may be placed in a container, which container is lowered by use of wire-line or coiled tubing. The desired amount of the second exothermic mixture is prepared at the surface and positioned in a container. The container may be any container suitable for lowering in to a well. Dependent on the desired operation, the container, or a set of a number of containers, may be a short or a long container. In a P&A operation, where the need of a large melting area is desired, the set of container may be several meters, ranging from 1 meter to 1000 meters. Alternatively, the second exothermic mixture may be circulated to the desired position in the well. The second exothermic mixture may be mixed with a fluid, forming a fluid mixture. The fluid mixture may be brought from the surface to the melting position in the well by circulation.

By the use of the described invention, all operations can be performed from a light well intervention vessel or similar, and the need for a dedicated large-scale rig, e.g. drilling rig, is eliminated.

The invention will now be described in non-limiting embodiments and with reference to the attached drawings, wherein;

DETAILED DESCRIPTION OF A PREFERENTIAL EMBODIMENT

Figure 1:
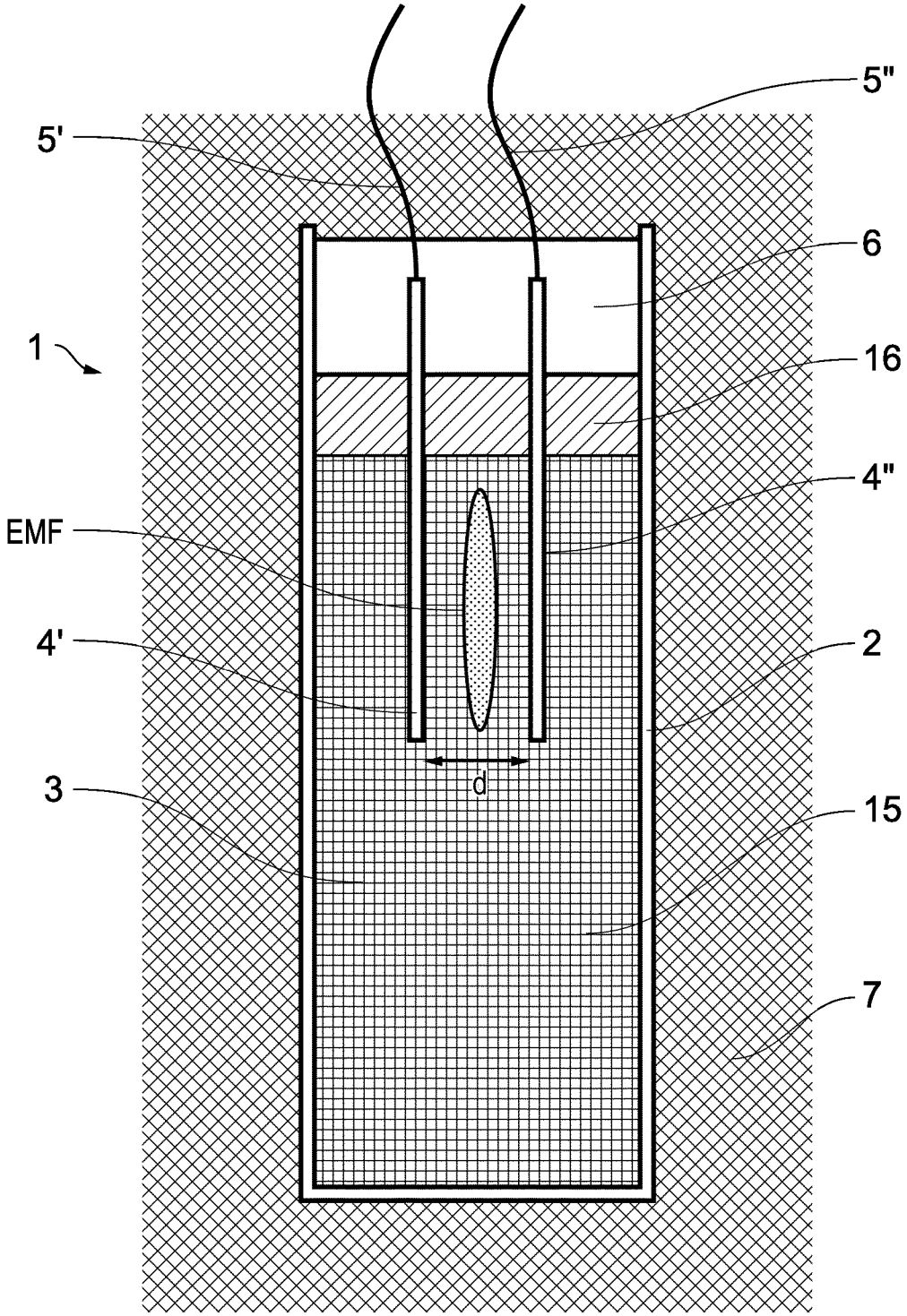
FIG. 1 shows an embodiment of the ignitor according to the invention prior to the ignition of a first exothermic mixture.

FIG. 1 shows an embodiment of the ignitor 1 according to the invention prior to the ignition of a first exothermic mixture 15. In the disclosed embodiment, the ignitor is arranged at a location where it is enclosed by a material to be ignited, such as a second exothermic mixture 7.

The ignitor 1 comprises a housing 2. A compartment 3 is provided within the housing 2. A first exothermic mixture 15 is arranged in the compartment 3. The first exothermic mixture 15 may be a mixture of at least a metal and an oxide provided in the compartment 3. A first electrode 4' connectable to a first terminal (not shown) of an external power supply is at least partly in contact with the first exothermic mixture 15. A second electrode 4" connectable to a second terminal (not shown) of external power supply is at least partly in contact with the first exothermic mixture 15. The first electrode 4' and the second electrode 4" are provided at a distance from each other, typically in parallel, such that the distance d is the same along the length of the first and second electrodes 4', 4" in contact with the first exothermic mixture 15. Upon appliance of a voltage above a predetermined threshold value between the first and second electrodes 4', 4" an electromagnetic field EMF is created in the first exothermic mixture 15 between the first and second electrodes 4', 4". The electromagnetic field EMF is indicated by the grey-scaled area in FIG. 1.

The first and second electrodes 4' 4" extend to a power supply located outside the ignitor 1. Hence, if the power supply is located on the surface it is not a part of the ignitor 1 as such, but if the power supply is in the form of a battery and time switch or timer, it may be lowered together with the ignitor 1 and possibly form part of the ignitor 1. The appliance of voltage may be performed by an operator or it may be a timer function. If the igniter is arranged in a well and applied by manual operation by an operator, the operator may be located at a surface on land or on an offshore vessel or platform (not shown). The operator may then apply a voltage on the surface which is transmitted to the dedicated first and second electrodes 4', 4" through one or more electric conductors 5', 5". In the disclosed embodiment in FIG. 1, the first electrode 4' is connected to a first electric conductor 5', while the second electrode is connected to a second electric conductor 5". The first and second electric conductors 5', 5" extend to a surface installation 22, such as any floating or fixed offshore installation.

The ignitor 1 is further disclosed comprising a holder 16 for holding the first electrode 4' and the second electrode 5'. The holder 16 can be formed of an electric isolating material. Further, the ignitor 1 comprises at least one pressure seal 6 adapted to seal against a pressure difference between an outside of the housing 2 and an inside of the housing 2. The pressure seal 6 may be a low-pressure seal 6, or alternatively a high pressure seal, depending on the requirements in the specific project.

Figure 2:
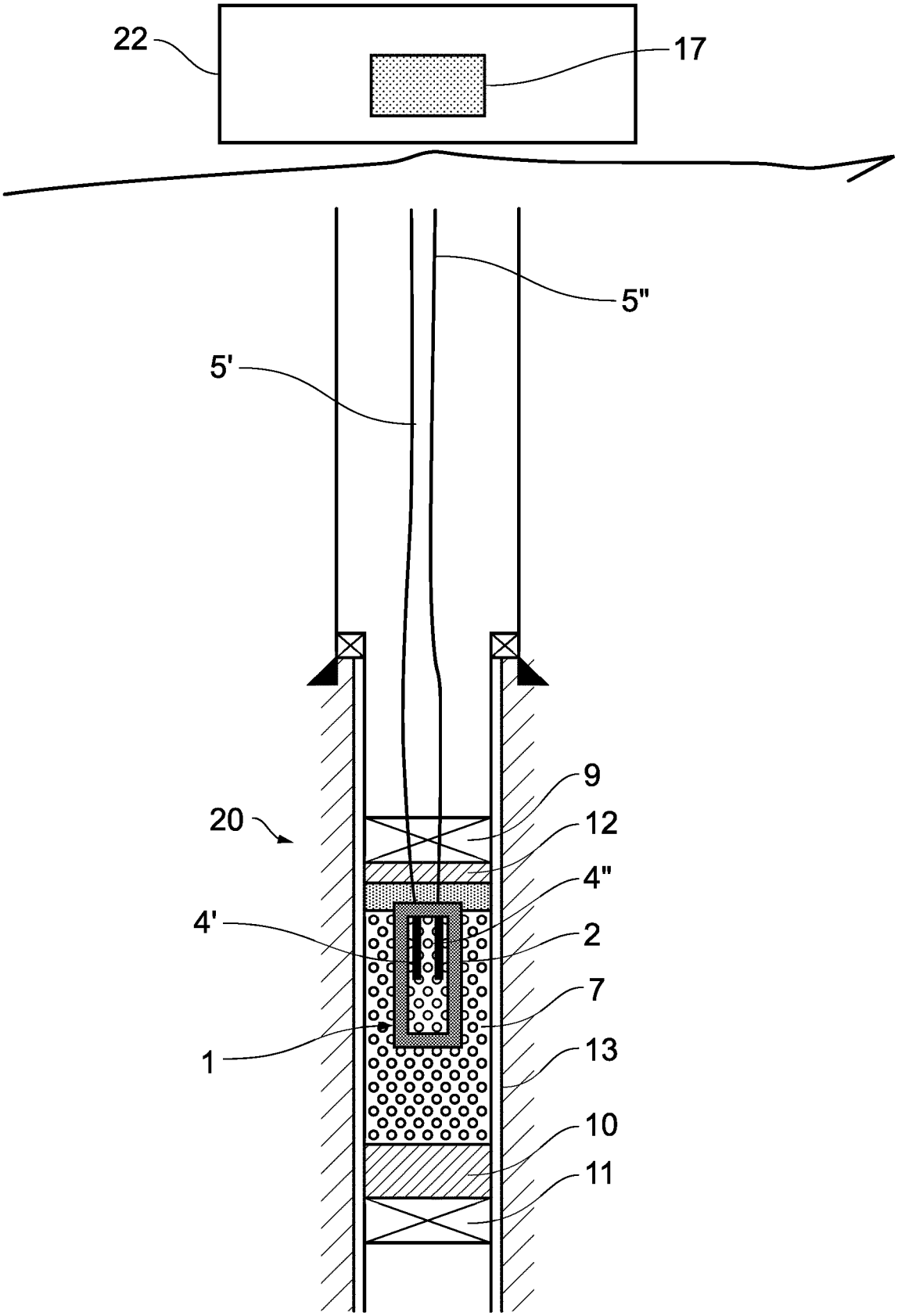
FIG. 2 is a sketch of an ignitor according to the present invention, and a system according to the present invention comprising the ignitor, prior to ignition of the ignitor.

FIG. 2 is a sketch of an ignitor 1 according to the present invention, and a system 20 according to the present invention comprising the ignitor 1. In the embodiment in FIG. 2, the ignitor 1 and system is arranged in a well, such as a hydrocarbon well. The ignitor 1 has the same features as the ignitor in FIG. 1. The system 20 comprises the ignitor 1 and some additional features such as a power supply (see FIG. 4, element 17). In the Figure only parts of a well is disclosed. The well is cased with a casing 13 cemented to the formation to provide for control of the formation pressure outside the well, i.e. avoid risk of (unintentional) inflow of fluids, such as gas, or unwanted production of water, sand, gas etc. The ignitor 1 is arranged inside the casing 13, and is partly enclosed by a second exothermic mixture 7. The second exothermic mixture 7 is thus ignited by the reactive heat resulting from the ignition of the first exothermic mixture 15 in the ignitor 1.

The second exothermic mixture 7 and the ignitor 1 are lowered to a desired location in the well. In FIG. 2, it is disclosed first and second high temperature resistant elements 10, 12 below and above the ignitor 1 in the well. The high temperature resistant elements may be formed of glass or ceramic. Additionally, it may be arranged permanent plugs 11, 9 below and above said first and second high temperature resistant elements 10, 12.

Figure 3:
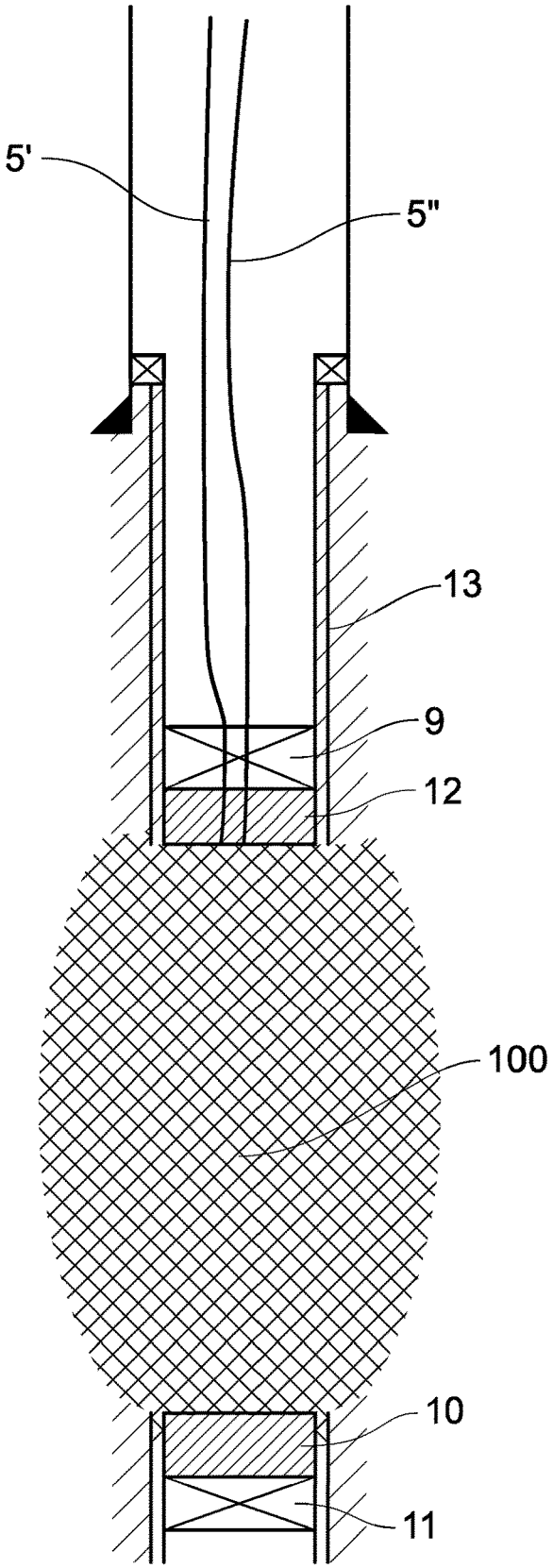
FIG. 3 is a similar sketch as in FIG. 2, but illustrates the situation after ignition of the ignitor.

FIG. 3 is a similar sketch as in FIG. 2, but illustrates the situation after a successful ignition of the ignitor 1 and thereby the second exothermic mixture 7. The heat generated from the ignition of the second exothermic mixture 7 has melted all of the ignitor 1, casing 13, pipes, a large amount of the radial surrounding formation (formation sand) etc. The melted area is denoted 100. The remaining parts of the well are the areas below and above the first and second high temperature resistant elements 10, 12, respectively.

Figure 4:
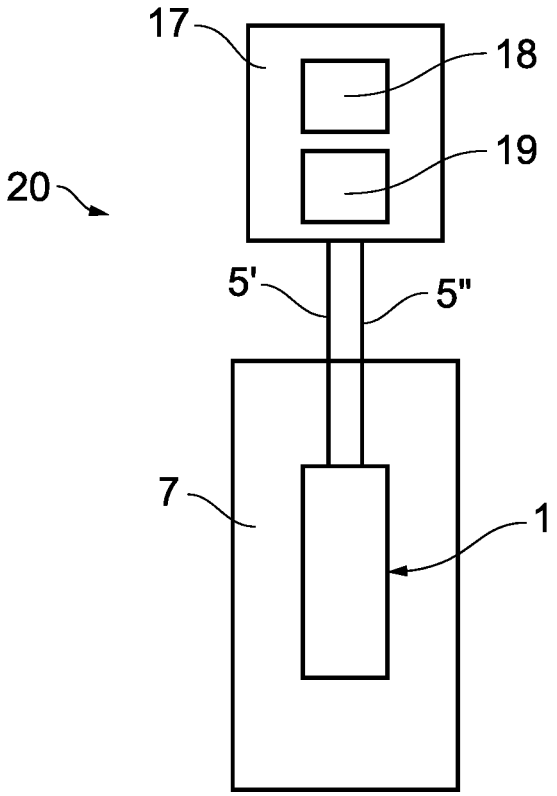
FIG. 4 is a simplified drawing of the system according to the present invention, comprising the ignitor, a second exothermic mixture and a power supply.

FIG. 4 is a simplified drawing of the system 20 according to the present invention, comprising the ignitor 1, a second exothermic mixture 7 and a power supply 17. The power supply 17 may comprise an electric power source 18 and a control device 19. Additionally, the power supply 17 may comprise a time switch and data for a successful ignition, such that an operator can decide, based on comparison with said data, whether the ignition has been successful or not. The electric power source 18 may comprise a battery. The power supply 17 including the battery and the control device 18 (including time switch) may be lowered down into the subterranean formation together with the ignitor 1 or, alternatively as disclosed in FIG. 2, it may be arranged on the surface.

Figure 5:
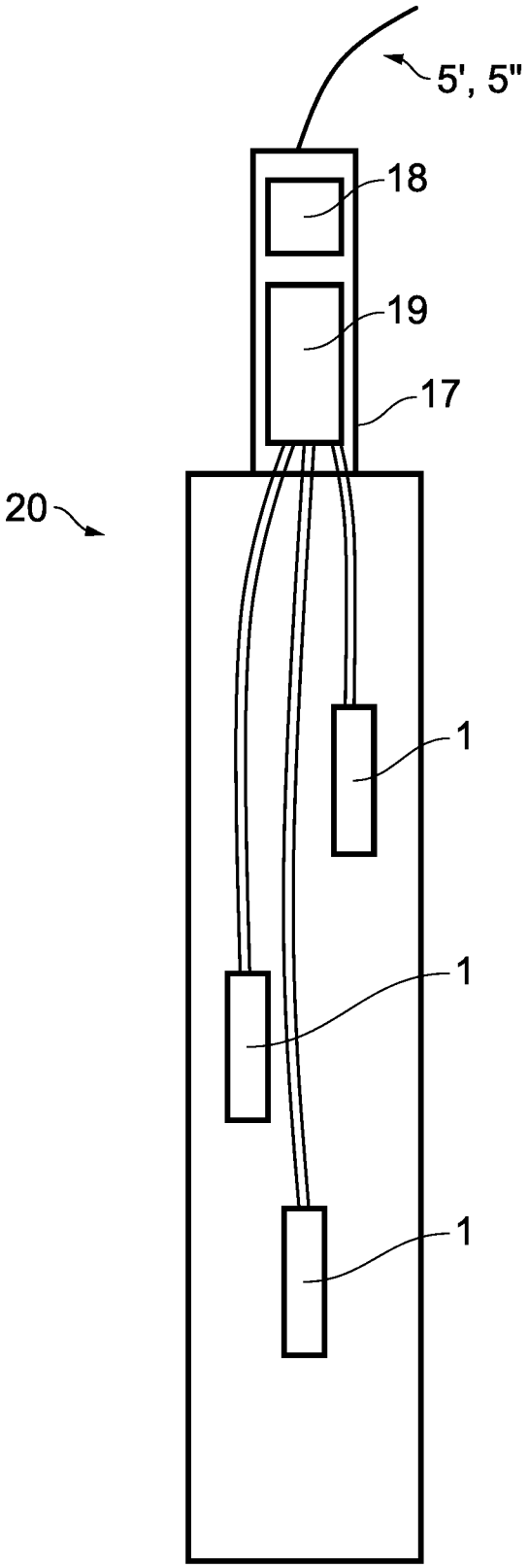
FIG. 5 shows an embodiment of a system according to the invention comprising three separate ignitors.

FIG. 5 shows an example of a system 20 comprising three ignitors 1. The ignitors 1 are connected to the control device 19 in the power supply 17. The control device may then, either by manual or automatic programming, direct voltage to the different ignitors 1 either simultaneously to all of the ignitors, or alternatively one at the time at given intervals. Such an arrangement provides redundancy in the system 1 because e.g. if one of the ignitors 1 fails to ignite, it is still two more possibilities for a successful ignition. It is obvious that the system 1 may comprise any other number than three different ignitors 1, such as two, four, five, six, seven etc. A larger number of ignitors will provide for even more redundancy in the system 1. The system can be run both with and without interpreting the results of the active signal, i.e. even if the first ignitor 1 has ignited, the control device will apply voltage to the electrodes in the second and third ignitors in a predefined ignition sequence. Alternatively, the system may be smart, i.e. by interpreting the signals received from the first ignitor and then, based on said signals, decide on which ignitor to apply voltage next.

Figure 6:
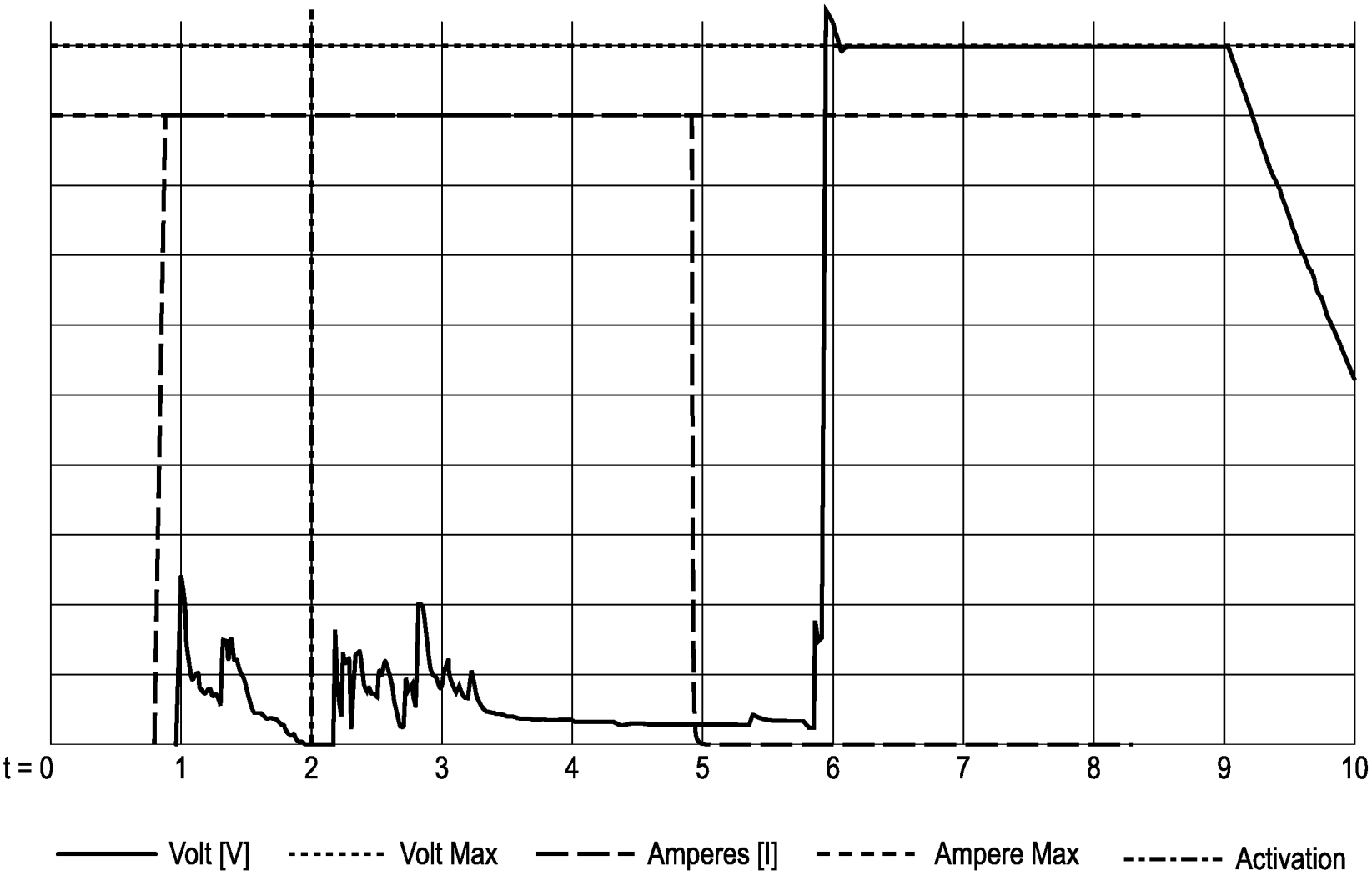
FIG. 6 discloses a plot of current as a function of applied voltage of a successful ignition.

FIG. 6 discloses a plot of current as a function of applied voltage of a successful ignition to check whether the ignition has been successful or not. The Figure shows a plot of voltage and current over a period t=0 to 10, these are the actual readings sent from the power supply and in which will be used to confirm or deny the activation success. From t=0 to t=1 there is a delay in the power source to insure that the entire process is logged. As the voltage is sent from the power supply, the resistance in the first exothermic mixture results in a current transfer through the material. As the connection is made, the voltage flows intermittent and the current is stable, at t=2 successful ignition is confirmed by comparing with existing data and experience.

By the arrangement of the embodiments of the figures a proposed solution to the object of the invention is explained, which is to provide a reliable ignitor, a system comprising the electrical ignitor as well as a method rendering use of the electrical ignitor for igniting at least a second exothermic mixture.

The invention is herein described in non-limiting embodiments. The skilled person will understand that the embodiments may be varied and modified without departing from the scope of the invention as set forth in the attached claims.

The invention claimed is:

1. An ignitor for use in a wellbore, the ignitor comprising:
a housing;
a compartment provided within the housing;
a first exothermic mixture of at least a metal and an oxide provided in the compartment,
wherein the first exothermic mixture comprises fine-grained particles of metal and
oxide particles having a particle size between 0.1 and 1 mm;
a first electrode connectable to a first terminal of a power supply; and
a second electrode connectable to a second terminal of the power supply;
wherein at least parts of the first and second electrodes are in contact with the first exothermic mixture,
wherein the first electrode and the second electrode are provided at a distance from each other, and
wherein, upon appliance of a voltage above a predetermined threshold value between the first and second electrodes, an electromagnetic field is created in the first exothermic mixture between the first and second electrodes.

2. The ignitor according to claim 1, wherein the ignitor further comprises a holder for holding the first electrode and the second electrode, wherein the holder is made of an electric isolating material.

3. The ignitor according to claim 1, wherein the housing further comprises at least one pressure seal configured to seal against a pressure difference between an outside of the housing and an inside of the housing.

4. The ignitor according to claim 1, wherein the first and second electrodes are formed of a metal alloy having a melting temperature above 1400° C.

5. The ignitor according to claim 1, wherein the first electrode and second electrode are embedded in the first exothermic mixture.

6. A system for electric ignition of an exothermic mixture in a wellbore, the system comprising at least one ignitor according to claim 1, wherein the system further comprises the power supply, wherein the first terminal of the power supply is connected to the first electrode of the ignitor and the second terminal of the power supply is connected to the second electrode of the ignitor, and wherein the power supply comprises an electric power source and a control device.

7. The system according to claim 6, wherein the control device comprises a switch device connected between the ignitor and the electric power source.

8. The system according to claim 7, wherein the electric power source comprises a battery, and wherein the switch device is a time switch.

9. The system according to claim 6, further comprising a second exothermic mixture comprising at least a metal and an oxide, wherein the second exothermic mixture at least partly encloses said housing, such that an ignition of the first exothermic mixture ignites the second exothermic mixture.

10. The system according to claim 9, wherein the power supply comprises data for representation of previous successful ignitions, and wherein an operator may decide whether an ignition has been successful or not based on comparison with said data.

11. The system according to claim 9, wherein the second exothermic mixture comprises iron oxide and aluminium.

12. The system according to claim 9, wherein the second exothermic mixture fully encloses the housing.

13. A method of activating an exothermic mixture comprising:
locating a second exothermic mixture at a desired position in a well,
locating an ignitor in proximity of the second exothermic mixture, the ignitor
comprising:
a housing;
a compartment provided within the housing;
a first exothermic mixture provided in the compartment, wherein the first exothermic mixture comprises fine-grained particles of metal and oxide particles having a particle size between 0.1 and 1 mm;
a first electrode connectable to a first terminal of a power supply;
a second electrode connectable to a second terminal of the power supply;
wherein the first electrode and the second electrode are provided at a distance from each other; and
applying a voltage above a certain threshold value between the first and second electrodes thereby creating an electromagnetic field in the first exothermic mixture between the first and second electrodes.

* * * * *